US011834613B2

(12) United States Patent
Nanda et al.

(10) Patent No.: US 11,834,613 B2
(45) Date of Patent: Dec. 5, 2023

(54) CRUDE OIL STABILIZATION

(71) Applicant: T.EN Process Technology, Inc., Houston, TX (US)

(72) Inventors: Rajeev Nanda, Katy, TX (US); Praveen Kumar, Sugar Land, TX (US); Cong Dinh, Sugar Land, TX (US)

(73) Assignee: T.EN Process Technology Inc., Houston, TX (US)

( * ) Notice: Subject to any disclaimer, the term of this patent is extended or adjusted under 35 U.S.C. 154(b) by 77 days.

(21) Appl. No.: 16/203,387

(22) Filed: Nov. 28, 2018

(65) Prior Publication Data

US 2020/0165528 A1 May 28, 2020

(51) Int. Cl.

| | |
|---|---|
| ***C10G 1/02*** | (2006.01) |
| ***C10G 7/00*** | (2006.01) |
| ***C10G 33/06*** | (2006.01) |

(52) U.S. Cl.

CPC ..... *C10G 1/02* (2013.01); *C10G 7/00* (2013.01); *C10G 33/06* (2013.01); *C10G 2300/1033* (2013.01); *C10G 2300/4012* (2013.01)

(58) Field of Classification Search

None

See application file for complete search history.

(56) References Cited

U.S. PATENT DOCUMENTS

| | | | | |
|---|---|---|---|---|
| 3,295,371 | A | 1/1967 | Smith | |
| 9,988,581 | B2 | 6/2018 | Meyer | |
| 2007/0267325 | A1 | 11/2007 | Vu | |
| 2012/0160103 | A1 | 6/2012 | Suppiah et al. | |
| 2015/0073196 | A1* | 3/2015 | Miller | B01D 3/26 585/802 |
| 2016/0160130 | A1* | 6/2016 | Martin | C10L 1/08 208/354 |
| 2017/0335205 | A1 | 11/2017 | Meyer | |
| 2018/0187095 | A1 | 7/2018 | Soliman | |
| 2020/0165528 | A1 | 5/2020 | Nanda et al. | |
| 2022/0064547 | A1* | 3/2022 | Soliman | C10G 31/06 |
| 2022/0380684 | A1* | 12/2022 | Soliman | C10G 7/02 |
| 2022/0380687 | A1* | 12/2022 | Soliman | B01D 19/0063 |

FOREIGN PATENT DOCUMENTS

KR 10-2015-0001929 A 1/2015

OTHER PUBLICATIONS

PCT International Search Report and Written Opinion dated Jan. 30, 2020, issued during the prosecution of PCT International Patent Application No. PCT/US2019/063582.

PCT International Search Report and Written Opinion dated Jul. 8, 2022, issued during the prosecution of PCT International Patent Application No. PCT/US2022/024454.

* cited by examiner

*Primary Examiner* — Tam M Nguyen

(74) *Attorney, Agent, or Firm* — Locke Lord LLP; Nicholas J. DiCeglie, Jr.; Christopher J. Capelli

(57) ABSTRACT

A system for stabilizing a hydrocarbon feedstock includes a High Pressure Separation (HPS) unit in fluid communication with a feedstock inlet. The HPS unit includes an oil outlet. A Heated Low Pressure (LP) Separator unit is downstream from the oil outlet of the HPS unit. The Heated LP Separator unit includes an oil outlet.

13 Claims, 2 Drawing Sheets

CRUDE OIL STABILIZATION

BACKGROUND OF THE INVENTION

1. Field of the Invention

The embodiments disclosed herein relate to crude oil stabilization separation systems and processes. More particularly, the embodiments disclosed herein provide improved stabilization systems and processing of crude oils including shale oil or tight oil, resulting in fewer separation stages.

2. Description of Related Art

It is common commercial practice to produce a stabilized crude oil for storage in a stock oil storage tank at the wellhead by treating a mixed stream of crude oil and natural gas to obtain a stabilized liquid hydrocarbon stream and a gaseous stream. This stabilization is typically carried out in a stabilization unit. The treating step is also referred to as a stabilization process.

The stabilization process helps to make the crude liquid hydrocarbons more suitable for further processing or handling, such as safe storage and/or for shipment in tankers. The stabilization process is commonly a multistage gas-liquid separation process, designed to separate lighter hydrocarbons, and thereby reducing vapor pressure to meet a desired specification such as a Reid Vapor Pressure (RVP) which is commonly used to ensure that the crude oil from the stabilization unit is acceptable for storage and/or transportation by a sea-going vessel such as an oil tanker and usually is less than 10 psi (68.9 kPag). The stabilization process often takes place in areas where available space may be limited, the site may be remote and/or skilled labor may not be available for construction.

Exemplary prior art of separation systems for stabilizing conventional crude oils is shown in FIG. 1 and identified by numeral 10. In the system 10, hydrocarbon feedstock, called well fluid 11, is first subjected to a high-pressure (75 to 250 psig, 517 to 1723 kPag) separation in a High Pressure Separator (HPS) unit 2, in which a bulk of the water 17 and gas 13 is removed. The un-stabilized oil 15, still containing some gas, light hydrocarbons and some water is further directed to a heated medium pressure separator unit 4, called a Heater Treater, operating at a temperature between 100° F. and 140° F. (37.7° C. and 60° C.). The Heater Treater unit 4 typically operates at a pressure ranging from 20-50 psig (138-345 kPag) and facilitates the separation of water and light end hydrocarbons from oil. In this prior art, only a partial separation of light end hydrocarbons takes place at the vapor outlet 19 of the Heater Treater unit 4. To achieve the desired stabilization of oil and the desired RVP, other lower pressure separation stages, namely a Vapor Recovery Tower (VRT) unit 14 operating at 1-7 psig (7-48 kPag), and oil storage tanks unit 16 operating at about 0.1 psig (0.69 kPag) are typically required downstream from outlet 21. Hydrocarbon vapors 19 from the Heater Treater unit 4 and hydrocarbon vapors 27 from the VRT unit 14 are typically recovered in Vapor Recovery Units (VRU) 6 and/or 12 but hydrocarbon vapors 31 from the storage tanks unit 16 are typically released to atmosphere or flared. The stabilized oil 29, from storage tanks unit 16, is transported after flowrate measurement through a Lease Automatic Custody Transfer (LACT) unit 18.

Such conventional methods and systems have generally been considered satisfactory for their intended purpose. However, there is still a need in the art for more efficient and lower cost stabilization processes for crude oil including shale or tight oil. There also remains a need in the art for a stabilization system with a smaller footprint that is easier to be modularized for better feasibility at remote locations. Additional objects of the present invention will become apparent from the following summary and detailed discussion of preferred embodiments of this invention.

SUMMARY OF THE INVENTION

A system for stabilizing a hydrocarbon feedstock includes a High Pressure Separation (HPS) unit in fluid communication with a feedstock inlet. The HPS unit includes an oil outlet. A Heated Low Pressure (LP) Separator unit is downstream from the oil outlet of the HPS unit. The Heated LP Separator unit includes an oil outlet.

The Heated LP Separator can include a gas product outlet and/or a water product outlet. In accordance with some embodiments, a vapor recovery unit (VRU) is downstream from and in fluid communication with the gas product outlet of the Heated LP Separator unit to recover hydrocarbon vapor therefrom. The Heated LP Separator unit can be configured to operate at a pressure less than 20 psig (138 kPag), and/or can be configured to operate at a pressure from 3 psig to 10 psig (21 kPag to 69 kPag). The Heated LP Separator unit can be configured to operate at a temperature above 110° F. (51.7° C.). In some embodiments, the Heated LP Separator unit is configured to operate at a temperature ranging from 110° F. to 160° F. (51.7° C. to 66.1° C.). The stabilized oil outlet of the Heated LP Separator unit can be configured to discharge stabilized oil having a Reid Vapor Pressure (RVP) of less than 10 psi (69 kPag). A Lease Automatic Custody Transfer (LACT) unit can be downstream from and in fluid communication with the stabilized oil outlet. The system can be a two-stage separation system. The HPS unit is configured to operate at a pressure ranging from 75 psig to 250 psig. The HPS unit can include a gas product outlet and/or a water product outlet.

In accordance with another aspect, a process for stabilizing a hydrocarbon feedstock includes delivering the hydrocarbon feedstock to a feedstock inlet of a HPS unit, and pressurizing the hydrocarbon feedstock in the HPS unit to separate a gas product and/or a water product from the hydrocarbon feedstock to generate an un-stabilized oil portion of the hydrocarbon feedstock. The process includes discharging the un-stabilized oil portion of the hydrocarbon feedstock from an un-stabilized oil outlet of the HPS unit, and delivering the un-stabilized oil portion of the hydrocarbon feedstock to a Heated Low Pressure (LP) Separator unit downstream from the un-stabilized oil outlet of the HPS unit. The process includes heating the un-stabilized oil portion of the hydrocarbon feedstock in the Heated LP Separator unit to separate a second gas product from the un-stabilized oil portion of the hydrocarbon feedstock to generate a stabilized portion of the hydrocarbon feedstock, and discharging the stabilized portion of the hydrocarbon feedstock from a stabilized oil outlet of the Heated LP Separator unit.

In accordance with some embodiments, pressurizing the hydrocarbon feedstock in the HPS unit includes operating the HPS unit at a pressure ranging from 75 psig to 250 psig (517 to 1723 kPag). Heating the un-stabilized oil portion of the hydrocarbon feedstock in the Heated LP Separator unit can include heating the hydrocarbon feedstock to a temperature above 110° F. (43.3° C.). It is contemplated that heating the un-stabilized oil portion of the hydrocarbon feedstock in the Heated LP Separator unit can include heating the hydrocarbon feedstock to a temperature ranging from 110° F. to 160° F. (43.3° C.-71.1° C.).

The method can include pressurizing the un-stabilized oil portion of the hydrocarbon feedstock in the Heated LP Separator unit by operating the Heated LP Separator at a pressure less than 20 psig (137.9 kPag). It is also contemplated that the method can include pressurizing the un-stabilized oil portion of the hydrocarbon feedstock in the Heated LP Separator unit by operating the Heated LP Separator at a pressure ranging from 3 psig to 10 psig (21 to 69 kPag).

In accordance with certain embodiments, the stabilized portion of the hydrocarbon feedstock that is discharged from the stabilized oil outlet of the Heated LP Separator unit has a Reid Vapor Pressure (RVP) of less than 10 psi (69 kPag). Discharging the stabilized oil portion of the hydrocarbon feedstock from the stabilized oil outlet of the Heated LP Separator unit can include discharging the stabilized portion of the hydrocarbon feedstock through a Lease Automatic Custody Transfer (LACT) unit downstream from and in fluid communication with the stabilized oil outlet. The hydrocarbon feedstock can be shale oil and/or tight oil. The method can include discharging the gas product through a gas product outlet of the HPS unit, discharging the second gas product from a gas product outlet of the Heated LP Separator unit, and/or recovering the second gas product with a VRU downstream from and in fluid communication with the gas product outlet of the Heated LP Separator unit.

The embodiments disclosed herein provide for reduced components for and overall size of the stabilization system, thereby reducing equipment, installation and operation costs.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 2:
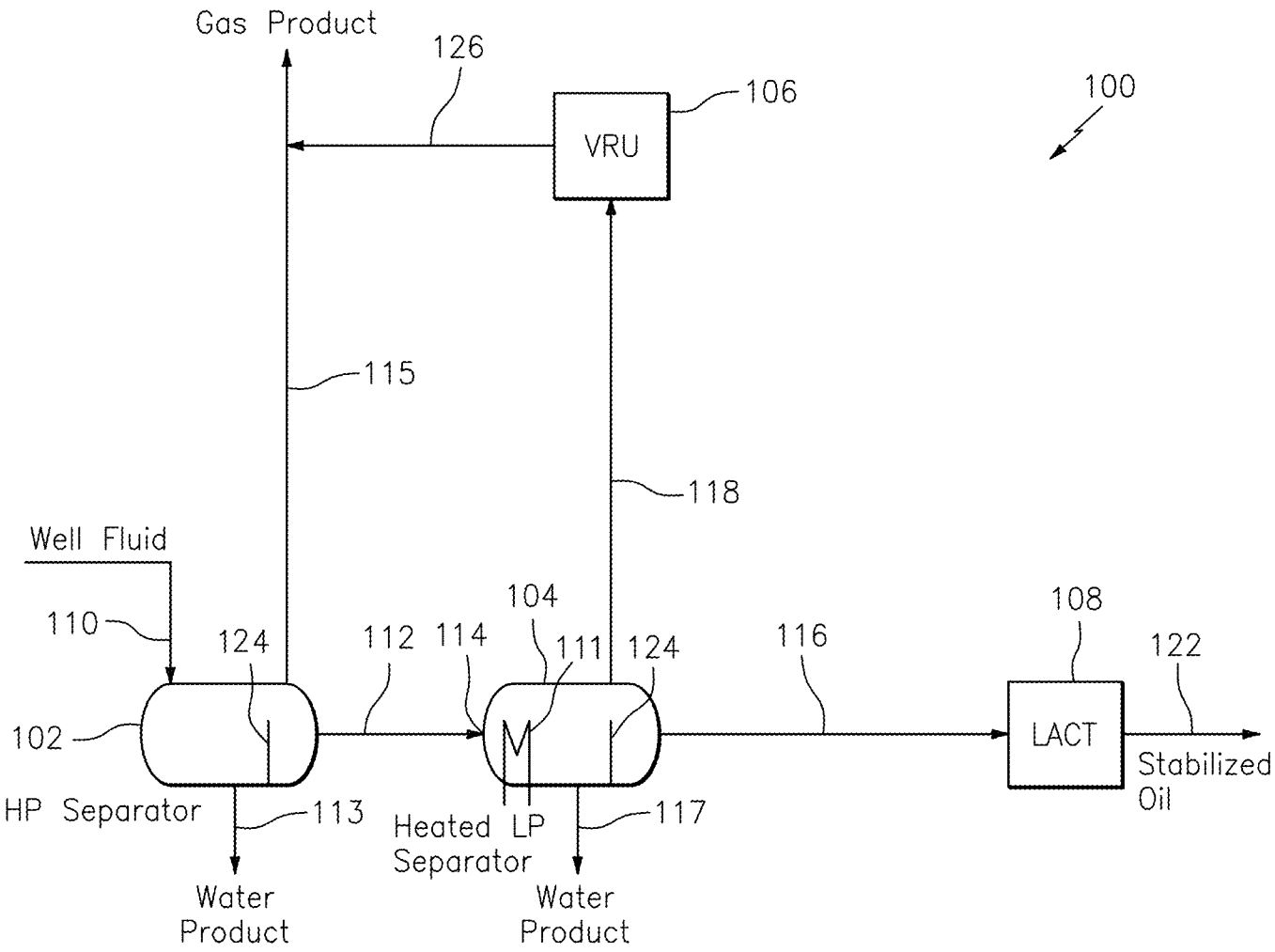
FIG. 2 is a schematic representation of an embodiment of a stabilization system constructed in accordance with the present disclosure that includes two-stages of separation.

Reference will now be made to the drawings wherein like reference numerals identify similar structural features or aspects of the subject invention. For purposes of explanation and illustration, and not limitation, a schematic representation of an exemplary embodiment of a stabilization system in accordance with the invention is shown in FIG. 2 and is designated generally by reference character 100. The methods and systems of the invention can be used for more efficient stabilization of crude oil, including shale or tight oil, which results in reduced operating costs and smaller size.

As shown in FIG. 2, system 100 is a two-stage separation unit for stabilizing a hydrocarbon feedstock. System 100 includes a three-phase High Pressure Separation (HPS) unit 102, e.g. the first stage, in fluid communication with a feedstock inlet 110. The HPS typically operates between 40° F. (4° C.) and 140° F. (60° C.). The term "three-phase" as used throughout the description refers to a vessel capable of separating a gas phase, hydrocarbon phase and aqueous phase into dedicated outlets. Feedstock can be a well fluid, like crude oil, e.g. shale oil or tight oil, or the like. HPS unit 102 includes an oil outlet 112, e.g. an un-stabilized oil outlet 112 (hydrocarbon phase), a gas product outlet 115 (gas phase), and a water product outlet 113 (aqueous phase). The separated gas that exits via the gas product outlet 115 is the associated natural gas which comes along with crude oil and water from the oil wells. The bulk of this gas typically constitutes methane. HPS unit 102 is the first stage of separation that separates the incoming well fluid into a gas stream, un-stabilized oil stream and water stream. In addition to gas product outlet, arrow 115 is used to schematically show the gas stream exiting HPS unit 102. In addition to water product outlet, arrow 113 is used to schematically show the water stream exiting HPS unit 102. In addition to un-stabilized oil outlet, arrow 112 is used to schematically show the un-stabilized oil stream exiting HPS unit 102. The operating pressure of HPS unit 102 is typically governed by the gas stream destination pressure. The HPS unit 102 includes an internal weir plate 124 that segregates water and oil.

A Heated Low Pressure (LP) Separator unit 104, e.g. the second stage, is a heated three-phase separator and is downstream from un-stabilized oil outlet 112 of HPS unit 102. The Heated LP Separator unit 104 includes an inlet 114, a heating input 111, a gas product outlet 118 (gas phase), a water product outlet 117 (aqueous phase), and an oil outlet 116, e.g. a stabilized oil outlet 116 (hydrocarbon phase). Gas product outlet and the gas stream associated therewith are both indicated schematically by the arrow 118 extending from Heated LP Separator unit 104. Water product outlet and the water product stream associated therewith are both indicated schematically by the arrow 117 extending from Heated LP Separator unit 104. Stabilized oil outlet and the stabilized oil stream associated therewith are both indicated schematically by the arrow 116 extending from Heated LP Separator unit 104. Inlet 114 is configured to receive the un-stabilized oil portion of the hydrocarbon feedstock that is discharged from HPS unit 102 via un-stabilized oil outlet 112. The Heated LP Separator unit 104 includes an internal weir plate 124 that segregates water and oil.

Heat is applied by way of heating input 111 to separate the un-stabilized oil stream 112 from the HPS unit 102 into the stabilized oil stream 116, the water stream 117 and the vapor stream 118. Depending on the composition and characteristics of the un-stabilized oil in stream 112, the operating pressure and temperature in the Heated LP Separator unit 104 is controlled to boil off the lighter hydrocarbons from the un-stabilized oil in stream 112 to result in the stabilized oil of oil stream 116. A typical Heater Treater, e.g. heater treater 4, is provided by flue gases from a fired heater flowing directly through internal fire tubes. While heating in the Heated LP Separator 104 is provided by multiple methods such as internal or external heat exchangers using external heating medium.

Heated LP Separator unit 104 is configured to operate at a pressure less than 20 psig (137.9 kPag), for example, in some embodiments Heated LP Separator unit 104 operates at a pressure ranging from 3 psig to 10 psig (21 kPa to 69 kPag). This is different from Heater Treater 4 (of FIG. 1) that typically operates at a pressure ranging from 20-50 psig (138-345 kPag). Heated LP Separator unit 104 is configured to operate at a temperature above 110° F. (43.3° C.), for example above 125° F. (51.7° C.). For example, in accordance with some embodiments, Heated LP Separator unit 104 is configured to operate at a temperature ranging from 110° F. to 160° F. (43.3° C.-71.1° C.). More specifically, in some embodiments, the Heated LP Separator unit 104 is configured to operate at a temperature ranging from 125° F. to 151° F. (51.7° C. to 66.1° C.). This operating pressure and temperature results in stabilization of the crude oil being achieved in Heated LP Separator unit 104 itself without excessive additional heating and suits well for light crude oil (including shale or tight oil) stabilization. The lower operating pressure and heating, per thermodynamics, aids in an easy release of light hydrocarbons from the oil thus stabilizing the oil in Heated LP Separator unit 104, instead of requiring additional stages of separation to stabilize the oil, e.g. like those required in system 10 downstream from Heater Treater unit 4. This tends to provide benefits as there is less equipment required, thereby reducing installation and operating costs by approximately 20 percent. Additionally, less equipment means a smaller stabilization system and less required plot space compared to a traditionally designed facility. The equipment of the present embodiments can be easily put on modules which saves installation and start-up time and the modules can be moved to new locations.

Stabilized oil outlet 116 of Heated LP Separator unit 104 is configured to discharge stabilized oil that meets the desired specifications, e.g. in embodiments of the present disclosure, having a Reid Vapor Pressure (RVP) of less than 10 psi (68.9 kPa). RVP is a common measure of the volatility of crude oil and other petroleum products. It is defined as the absolute vapor pressure exerted by a liquid at 100° F. (37.8° C.) and is determined by the test method ASTM Standard D-323 or equivalent. The term "stabilized oil" or "stabilized oil portion" as used throughout this description means crude oil with a vapor pressure low enough to comply with transport and storage requirements, which is indicated by Reid Vapor Pressure (RVP) of less than 10 psi at 100° F. (37.78° C.). It will be readily appreciated by those skilled in the art that the requirements for stabilization may vary or can be based on other parameters. A vapor recovery unit (VRU) 106 is downstream from and in fluid communication with the gas product outlet 118 of Heated LP Separator unit 104 to recover hydrocarbon vapors from Heated LP Separator unit 104. The VRU contains a gas compressor which increases the pressure of the vapors recovered from the Heater Treater or Heated LP Separator. The high pressure discharge vapors from the VRU combine with the gas product from the HPS and are routed to either a gas pipeline or a gas conditioning system. A Lease Automatic Custody Transfer (LACT) unit 108 is downstream from and in fluid communication with stabilized oil outlet 116. The LACT unit is provided for oil metering for custody transfer purposes. The LACT unit 108 receives the stabilized oil from stabilized oil outlet 116. From LACT unit 108, the stabilized oil can be discharged through a LACT outlet 122, after a flow rate measurement in the LACT unit 108, for safe storage or shipment. A LACT unit, like LACT unit 108, typically contains a flow meter, sampling system and provision of meter prover.

A process for stabilizing a hydrocarbon feedstock includes delivering the hydrocarbon feedstock into a feedstock inlet, e.g. feedstock inlet 110, of a HPS unit, e.g. HPS unit 102, separating gas and water products from the hydrocarbon feedstock in the HPS unit to generate an un-stabilized oil portion of the hydrocarbon feedstock. Processing the hydrocarbon feedstock in the HPS unit includes maintaining a pressure ranging from 75 to 250 psig (517 to 1723 kPag) in the HPS unit. In some embodiments, this includes maintaining a pressure ranging from 125 to 200 psig (862 to 1379 kPag). The process includes discharging the un-stabilized oil portion of the hydrocarbon feedstock from an outlet, e.g. un-stabilized oil outlet 112, of the HPS unit. The process includes delivering the un-stabilized oil portion of the hydrocarbon feedstock into a Heated LP Separator unit, e.g. Heated LP Separator unit 104, downstream from the un-stabilized oil outlet of the HPS unit, heating the un-stabilized oil portion of the hydrocarbon feedstock in the Heated LP Separator unit to separate a second gas product, e.g. that indicated schematically by gas product outlet 118, and a second water product, e.g. that indicated schematically by second water product outlet 117, from the un-stabilized oil portion of the hydrocarbon feedstock to generate a stabilized portion of the hydrocarbon feedstock, and discharging the stabilized portion of the hydrocarbon feedstock from a stabilized oil outlet, e.g. stabilized oil outlet 116, of the Heated LP Separator unit.

Figure 1:
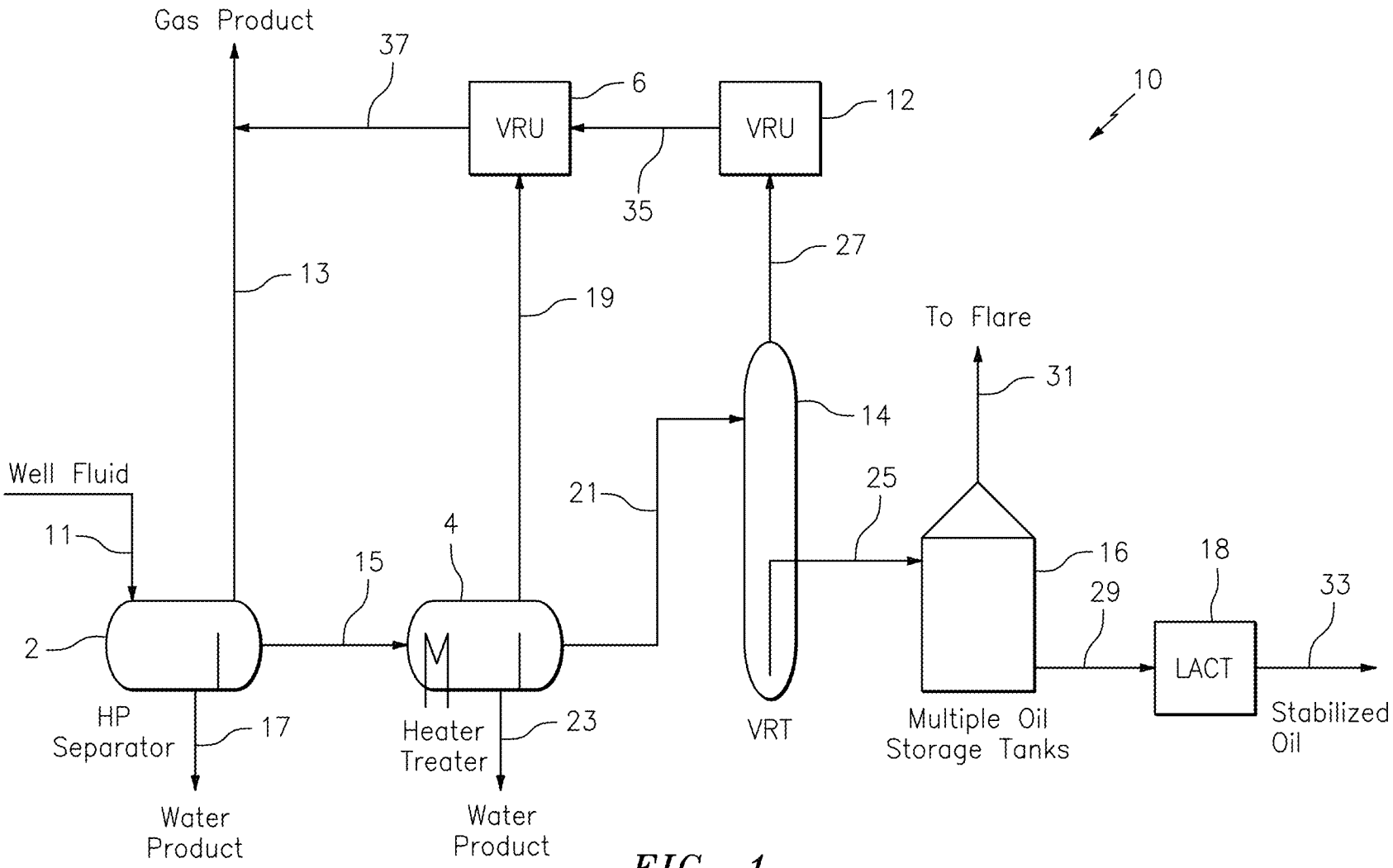
FIG. 1 is a schematic representation of a traditional stabilization system that includes more than three stages of separation.

With continued reference to FIG. 2, when comparing FIG. 1 with FIG. 2, it is clear that the footprint of the oil stabilization process of FIG. 2 is much smaller than that of FIG. 1 in that system 100 of FIG. 2 does not include a second VRU, e.g. VRU 12, a VRT, e.g. VRT 14, or any oil storage tanks, e.g. oil storage tanks 16. Instead, in embodiments of the present invention, the fluid discharged from stabilized oil outlet 116 is already stabilized such that a VRT and oil storage tanks are not necessary. Heating the un-stabilized oil portion of the hydrocarbon feedstock in the Heated LP Separator unit includes heating the hydrocarbon feedstock to a temperature above 110° F. (43.3° C.). It is contemplated that heating the un-stabilized oil portion of the hydrocarbon feedstock in the Heated LP Separator unit includes heating the hydrocarbon feedstock to a temperature ranging from 110° F. to 160° F. (43.3° C.-71.1° C.).

The method includes pressurizing the un-stabilized oil portion of the hydrocarbon feedstock in the Heated LP Separator unit by operating the Heated LP Separator unit at a pressure less than 20 psig (137.9 kPag). Some embodiments include pressurizing the un-stabilized oil portion of the hydrocarbon feedstock in the Heated LP Separator unit by maintaining a pressure ranging from 3 psig to 10 psig (21 to 69 kPag) in the Heated LP Separator unit.

The stabilized oil portion of the hydrocarbon feedstock that is discharged from the stabilized oil outlet of the Heated LP Separator unit has a Reid Vapor Pressure (RVP) of less than 10 psi (68.9 kPa). Discharging the stabilized oil portion of the hydrocarbon feedstock from the stabilized oil outlet of the Heated LP Separator unit includes discharging the stabilized oil portion of the hydrocarbon feedstock to a Lease Automatic Custody Transfer (LACT) unit, e.g. LACT unit 108, downstream from and in fluid communication with the stabilized oil outlet. The method includes discharging the gas product through a gas product outlet, e.g. gas product outlet 115, of the HPS unit, discharging the second gas product from a gas product outlet, e.g. gas product outlet 118, of the Heated LP Separator unit, and/or recovering the second gas product with a vapor recovery unit (VRU) downstream, e.g. VRU unit 106, from and in fluid communication with the gas product outlet of the Heated LP Separator unit. While the described system and method are described in the context of light feedstocks, e.g. shale oil or tight oil, the claimed method and system can process other suitable types of feedstocks as well.

Embodiments of the present disclosure provide for stabilization systems and methods that, due to a modification to the temperature and pressure of an upstream separator, e.g. the Heated LP Separator unit, require only two separation stages, where traditional systems require more. The embodiments of the present disclosure, can reduce overall installation and operating costs by approximately twenty percent as compared with traditional systems and processes, and reduce the plot space required. Moreover, for installation and start-up, the equipment of the presently claimed system can be easily assembled in modular form, which can save installation and start-up time and increase ease of transport and better suited for relocation.

The methods and systems of the embodiments of the present disclosure, as described above and shown in the drawings, provide for stabilization systems with increased efficiency, reduced cost and smaller size. While the apparatus and methods of the subject invention have been shown and described with reference to preferred embodiments, those skilled in the art will readily appreciate that changes and/or modifications may be made thereto without departing from the spirit and scope of the subject invention. The above description and examples are merely illustrative of the invention and should not be construed as limiting the scope of the invention. Various modifications will become apparent to the skilled artisan in view of the foregoing disclosure. It is intended that all such modifications coming within the scope and spirit of the appended claims should be embraced thereby.

What is claimed is:

1. A process for stabilizing a hydrocarbon feedstock comprising:

delivering the hydrocarbon feedstock to a feedstock inlet of a High Pressure Separation (HPS) unit in a separation stage between the feedstock inlet and a stabilized oil outlet, wherein the separation stage between the feedstock inlet and the stabilized oil outlet consists of only two stages of separation, wherein a first stage of separation is the HPS unit and a second stage of separation is a Heated LP Separator unit;

pressurizing the hydrocarbon feedstock in the HPS unit to separate at least one of a gas product or a water product from the hydrocarbon feedstock to generate an un-stabilized oil portion of the hydrocarbon feedstock;

discharging the un-stabilized oil portion of the hydrocarbon feedstock from an oil outlet of the HPS unit;

delivering the un-stabilized oil portion of the hydrocarbon feedstock directly to the Heated Low Pressure (LP) Separator unit downstream from the oil outlet of the HPS unit, wherein the LP separator unit includes a single vessel having an un-stabilized oil inlet, the stabilized oil outlet downstream from the oil inlet, a gas product outlet and a water product outlet;

heating the un-stabilized oil portion of the hydrocarbon feedstock in the Heated LP Separator unit with a heating input between the un-stabilized oil inlet and the un-stabilized oil outlet to separate at least one of a second gas product or a second water product from the un-stabilized oil portion of the hydrocarbon feedstock to generate a stabilized oil portion of the hydrocarbon feedstock; and discharging the stabilized portion of the hydrocarbon feedstock from the stabilized oil outlet of the Heated LP Separator unit.

2. The process of claim 1, wherein pressurizing the hydrocarbon feedstock in the HPS unit includes operating the HPS unit at a pressure ranging from 75 psig to 250 psig to the hydrocarbon feedstock.

3. The process of claim 1, wherein heating the un-stabilized oil portion of the hydrocarbon feedstock in the Heated LP Separator unit includes heating the hydrocarbon feedstock to a temperature above 110° F.

4. The process of claim 1, wherein heating the un-stabilized oil portion of the hydrocarbon feedstock in the Heated LP Separator unit includes heating the hydrocarbon feedstock to a temperature ranging from 110° F. to 160° F.

5. The process of claim 1 further comprising pressurizing the un-stabilized oil portion of the hydrocarbon feedstock in the Heated LP Separator unit by operating the Heated LP Separator at a pressure less than 20 psig.

6. The process of claim 1, further comprising pressurizing the un-stabilized oil portion of the hydrocarbon feedstock in the Heated LP Separator unit by operating the Heated LP Separator unit at a pressure ranging from 3 psig to 10 psig.

7. The process of claim 1, wherein the stabilized portion of the hydrocarbon feedstock discharged from the oil outlet of the Heated LP Separator unit has a Reid Vapor Pressure (RVP) of less than 10 psi.

8. The process of claim 1, wherein discharging the stabilized portion of the hydrocarbon feedstock from the oil outlet of the Heated LP Separator unit includes discharging the stabilized portion of the hydrocarbon feedstock to a Lease Automatic Custody Transfer (LACT) unit downstream from and in fluid communication with the oil outlet of the Heated LP Separator unit.

9. The process of claim 1, wherein the hydrocarbon feedstock is at least one of shale oil or tight oil.

10. The process of claim 1, further comprising discharging the gas product through a gas product outlet of the HPS unit.

11. The process of claim 1, further comprising discharging the second gas product from a gas product outlet of the Heated LP Separator unit.

12. The process of claim 11, further comprising recovering the second gas product with a vapor recovery unit downstream from and in fluid communication with the gas product outlet of the Heated LP Separator unit.

13. The process of claim 11, further comprising recovering the second gas product with a vapor recovery unit downstream from and in fluid communication with the gas product outlet of the Heated LP Separator unit.

* * * * *